US005350612A

United States Patent [19]

Stern et al.

[11] Patent Number: 5,350,612

[45] Date of Patent: Sep. 27, 1994

[54] WET-STRENGTH REMOVABLE COUPON

[75] Inventors: Michael D. Stern, Medford, N.J.; Stephen G. Dudley, Coatesville; Dale D. Reschenberg, Langhorne, both of Pa.

[73] Assignee: Beckett Corporation, Pa.

[21] Appl. No.: 924,519

[22] Filed: Aug. 4, 1992

[51] Int. Cl.[5] ..... G09F 3/00

[52] U.S. Cl. ..... 428/40; 40/310; 40/630; 162/165; 162/166; 428/195; 428/202; 428/211; 428/212; 428/323; 428/327; 428/348; 428/352; 428/354; 428/355; 428/535; 428/537.5; 428/914; 524/277; 524/425; 524/478; 524/488

[58] Field of Search ..... 428/40, 41, 42, 195, 428/343, 354, 352, 348, 212, 355, 202, 211, 409, 535, 537.5, 914, 323, 330, 327; 40/310, 630; 283/81, 101; 162/165, 166; 524/488, 478, 277, 425, 427, 539

[56] References Cited

U.S. PATENT DOCUMENTS

| | | | |
|---|---|---|---|
| 3,131,106 | 4/1964 | Mackenzie | 156/230 |
| 3,212,913 | 10/1965 | Mackenzie | 428/206 |
| 3,245,857 | 4/1966 | Rutledge | 40/310 |
| 3,657,066 | 4/1972 | Chene | 162/182 |
| 4,355,074 | 10/1982 | Stemmler | 428/40 |
| 4,479,838 | 10/1984 | Dunsirn | 156/247 |
| 4,863,772 | 9/1989 | Cross | 156/248 |
| 5,024,014 | 6/1991 | Swierczek | 40/310 |

FOREIGN PATENT DOCUMENTS

| | | | |
|---|---|---|---|
| 1811915 | 9/1970 | Fed. Rep. of Germany | 40/310 |

OTHER PUBLICATIONS

Pulp and Paper, Chemistry and Chemical Technology, Third Edition, vol-III, Wiley-Interscience Publication, p. 1788.

*Primary Examiner*—Ellis P. Robinson
*Assistant Examiner*—Nasser Ahmad
*Attorney, Agent, or Firm*—Ostrolenk, Faber, Gerb & Soffen

[57] ABSTRACT

A multi-ply, wet-strength, removable label or coupon for packages intended for retail use, particularly suitable for items where refrigeration and/or condensation is a condition of the product life cycle. The coupon structure includes a base ply formed of moisture resistant, wet-strength paper with printable or coatable upper and under sides. The base ply is adhered to a removable top ply with a combination of bonding agents and release coatings. The top ply may also be moisture resistant. The coupon structure is preferably supplied in a cut-sheet format for convenient use and storage.

6 Claims, 2 Drawing Sheets

WET-STRENGTH REMOVABLE COUPON

BACKGROUND OF THE INVENTION

1. Field of the Invention

The present invention relates to a structure for a promotional coupon attachable to the surface of containers used in refrigerated and other moisture-laden environments. More specifically, the invention relates to a wet-strength coupon structure consisting of a base ply and a top ply with a fugitive adhesive therebetween to permit removal and redemption of the top ply.

2. Description of the Related Art

Recently, packages and containers have utilized pressure-sensitive peel-off and/removable coupons as secondary elements of the container. See, e.g., U.S. Pat. No. 4,994,089 to Schwartz; U.S. Pat. No. 4,767,654 to Riggsbee; U.S. Pat. No. 4,863,772 to Cross; U.S. Pat. No. 4,345,393 to Price et al.; U.S. Pat. No. 4,281,762 to Hattimer; and U.S. Pat. No. 4,479,838 to Dunsirn et al. The inventions disclosed in all of the above patents address promotional needs of manufacturers with no regard to the problems faced in a moisture-laden environment. However, in a condition where refrigeration and continual removal from refrigeration occurs, condensation may form on a container as a condition of temperature and humidity. Degradation of normal untreated paper occurs rapidly as moisture penetrates the porous paper surface.

More than 20 years ago, improvements in paper making resulted in water-resistant products. Papers that were high in water repellency, and improved wet-strength characteristics became commercially available. U.S. Pat. No. 3,589,978 to Kamal; U.S. Pat. No. 3,640,840 to Zieman et al.; U.S. Pat. No. 3,657,066 to Chene; U.S. Pat. No. 3,679,544 to Ashikaga et al; and U.S. Pat. No. 3,740,253 to Hattori relate to the manufacture and structure of highly water-resistant papers. Such wet-strength papers typically utilize self-cross-linking water soluble reaction products or resin precursors such as melamine formaldehyde to improve the bonding between paper fibers and thus their wet-state condition.

Although removable coupons and wet-strength labels are both available, no coupon structure has been devised to date which combines the features of removability and wet-strength. Yet, there is a long-felt need for such a structure, particularly for refrigerated products.

SUMMARY OF THE INVENTION

It is therefore an object of the present invention to provide a removable, point of purchase coupon structure utilizing highly water-resistant/wet-strength paper to minimize the damaging effect of moisture.

Another object of the invention is to provide a wet-strength removable coupon structure having printable base ply which can be viewed through a transparent or translucent container.

A further object of the invention is to provide maximum printing space utilizing all upper and under sides of a multi-ply coupon structure.

The invention achieves the above objectives by providing a multi-ply promotional label, which utilizes both a fugitive adhesive and moisture and/or solvent resistant papers.

BRIEF DESCRIPTION OF THE DRAWINGS

Other features and advantages of the present invention will become apparent when the following description is read in conjunction with the appended drawings, in which.

DESCRIPTION OF THE PREFERRED EMBODIMENT

Figure 1A:
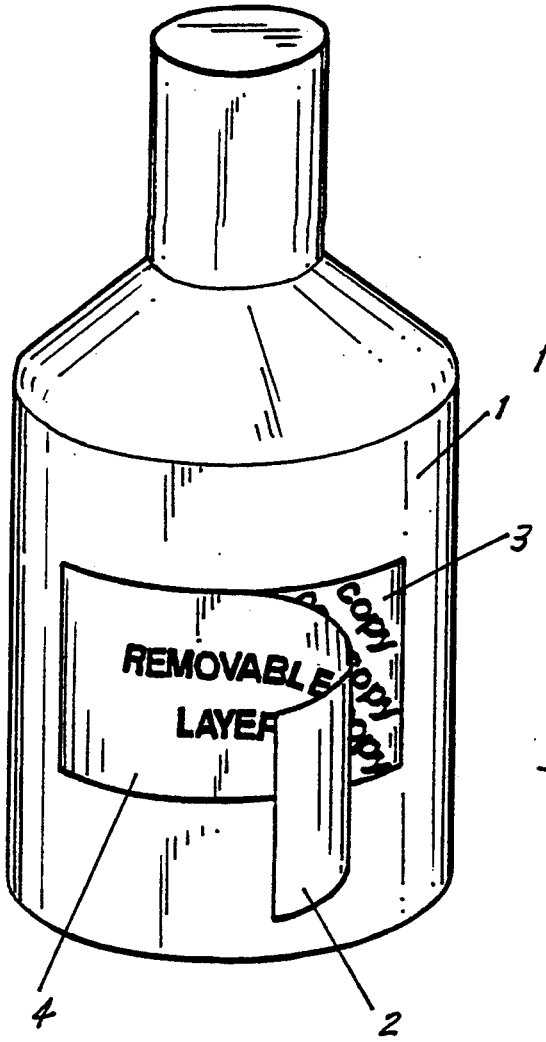
FIG. 1A is a front view which illustrates the invention as it is applied to the surface of a container.
Figure 1B:
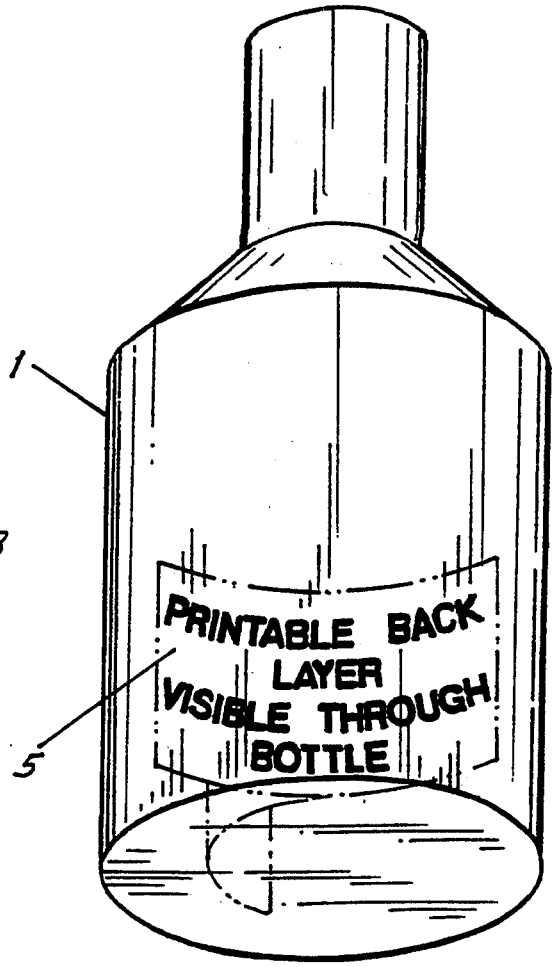
FIG. 1B is a back view which shows the invention viewed through the container from the back side.

Referring first to FIGS. 1A and 1B, the removable coupon of the present invention is shown attached to a container 1. The coupon structure includes a base ply having a front side 3 and a back-side 5, both of which can include printed matter as shown in FIGS. 1A and 1B. The coupon is preferably provided to the packager in cut-sheet format. A transparent adhesive is preferably employed by the packager to bond the base ply to container 1, such that the printed matter on backside 5 is visible through container 1.

A removable top ply having a front side 4 and a back-side 2 is adhered to the base ply, preferably by a fugitive (non-tacky) adhesive (described in detail below). Although not shown in FIG. 1A, back-side 2 of the top ply may also include printed matter.

Figure 2:
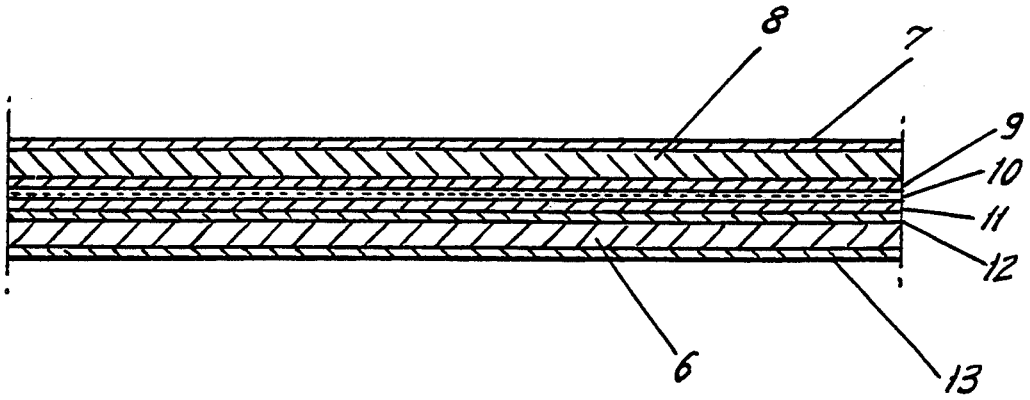
FIG. 2 is an enlarged sectional view of the invention in a flat condition.
Figure 3:
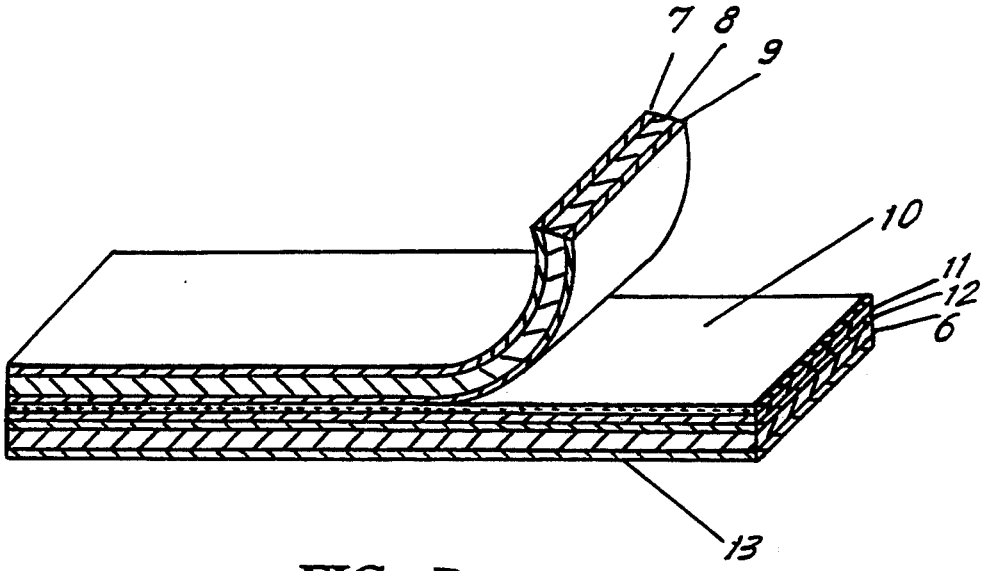
FIG. 3 is an enlarged sectional view of the invention, illustrating the separation of front and back panels.

FIGS. 2–3 show the structure of the coupon of the present invention in greater detail. As shown therein, the coupon consists of a base ply 6 with printed layers 12 and 13 on its upper and lower sides, respectively. The base ply 6 is advantageously formed of a wet-strength paper to resist moisture; the top ply 8 of the coupon may also consist of a wet-strength, moisture-resistant paper if, for example, the coupon is intended to be used for containers that are refrigerated prior to sale. Top ply 8 also preferably includes upper and lower printed layers 7 and 9, respectively. Release coatings 11 and a bonding agent 10 are disposed between base ply 6 and top ply 8 to removably adhere the two layers together.

In the preferred embodiment of the invention, bonding agent 10 contains approximately 50%–60% solids by weight comprising 80% microcrystalline (polyethylene) wax dispersion with a melting point of 140°–150° F., 10% inert filler extender (calcium carbonate type, mesh size 325 micron) and an acrylated emulsion of 10% with a glass transition temperature of −40° C. Bonding agent 10 preferably has a viscosity of 1,500–2,000 cps (#4 spindle 20 rpm Brookfield LVT Viscometer). Bonding agent 10 is applied by an anilox roller to either the top or base ply sheets before laminating the two sheets together.

Release coatings 11 are preferably comprised of a silicon modified polyacrylate UV cured system; such release coatings are commercially available from Environmental Inks & Coatings and BASF.

The preferred wet-strength paper for bottom ply 6 (and, in some applications, top ply 8) utilizes urea-formaldehyde as the active chemical agent; Silver Leaf UG (ultragrade) wet-strength paper is ideal.

The result is a coupon structure with a removable top-ply 8 and a base-ply 6 firmly attached to the container which is able to function in a moisture-laden environment while providing graphic integrity.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A multi-ply, wet-strength, removable, point-of-purchase coupon structure, comprising:

(a) a base sheet comprising a printable water-resistant, wet-strength paper having an upper side and an underside;

(b) a removable top sheet provided with printed matter on its upper side; and (c) a non-tacky adhesive disposed between the base sheet and the top sheet for releasably adhering the top sheet to the upper side of the base sheet, the non-tacky adhesive preventing the top sheet from adhering to other objects when the top sheet is removed, the non-tacky adhesive comprising:

(i) a bonding agent containing 50–60% solids by weight and comprising 80% microcrystalline wax dispersion with a melting point of 140°–150° F., 10% inert filler extender and 10% acrylated emulsion with a glass transition temperature of −40° C.; and (ii) a release coating disposed on the upper side of the base sheet between the bonding agent and the base sheet.

2. A coupon structure as recited in claim 1, wherein the top sheet comprises a water-resistant, wet-strength paper resistant to moisture penetration.

3. A coupon structure as recited in claim 1, wherein the top sheet has printed matter on its underside.

4. A coupon structure as recited in claim 1, wherein the underside of the base sheet is provided with a transparent adhesive for adhesively bonding the base sheet to a container, and the base sheet has printed matter on its underside which is viewable through the container.

5. A coupon structure as recited in claim 1, wherein the wet-strength paper comprises paper treated with urea-formaldehyde.

6. A coupon structure as recited in claim 1, wherein the underside of the base sheet is provided with an adhesive for adhesively bonding the base sheet to a container.

* * * * *